US007287872B2

(12) United States Patent
Kubota

(10) Patent No.: US 7,287,872 B2
(45) Date of Patent: Oct. 30, 2007

(54) SHELF ASSEMBLY

(75) Inventor: Harunobu Kubota, Ichikawa (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 48 days.

(21) Appl. No.: 11/270,266

(22) Filed: Nov. 9, 2005

(65) Prior Publication Data

US 2006/0103280 A1 May 18, 2006

(30) Foreign Application Priority Data

Nov. 12, 2004 (JP) ..... 2004-329713

(51) Int. Cl.
*F21S 9/02* (2006.01)

(52) U.S. Cl. ..... 362/127; 362/133; 362/418

(58) Field of Classification Search ..... 362/127, 362/133, 418, 427, 419, 125, 433, 449, 285, 362/250; 248/235, 239, 241, 243; 211/134, 211/186, 187; 108/149, 106, 109, 23
See application file for complete search history.

(56) References Cited

U.S. PATENT DOCUMENTS 5,909,863 A * 6/1999 Mansfield et al. ..... 248/235

FOREIGN PATENT DOCUMENTS

JP 8-73012 3/1996

OTHER PUBLICATIONS

Patent Abstracts of Japan, Publication No. 08-073012, Publication Date Mar. 19, 1996, 2 pages.

* cited by examiner

*Primary Examiner*—Sharon Payne
(74) *Attorney, Agent, or Firm*—Osha Liang LLP

(57) ABSTRACT

Upper support portions 4 are respectively provided at respective upper end sections of a pair of support columns 1, 1' such that the position of the upper support portions can be adjusted in an up-down direction. Lower support portions 5 are respectively provided at respective lower end sections of a pair of support columns 1, 1' such that the position of the lower support portions can be adjusted in an up-down direction. A pair of wires 13, 13 is provided to extend between the lower support portion 5 and the upper support portion 4 of the support column 1. Another pair of wires 13, 13 is provided to extend between the lower support portion 5 and the upper support portion 4 of the support column 1'.

18 Claims, 9 Drawing Sheets

SHELF ASSEMBLY

FIELD OF THE INVENTION

The invention relates to a shelf assembly that is used to display products or the like.

BACKGROUND OF THE INVENTION

Generally, this type of shelf assembly includes a pair of support columns, shelf boards that are supported at one end section and the other end section by the support columns, a pair of wires that extend between an upper end section and a lower end section of one of the pair of support columns, and a pair of wires that extend between an upper end section and a lower end section of the other of the pair of support columns. The shelf boards are connected to the pair of wires (refer to Japanese Patent Application Publication No. JP-A Hei. 8-73012), or lighting devices are provided on the pair of wires.

The above described shelf assembly is supported by fixing the respective lower end sections of the pair of support columns to the floor, and fixing the respective upper end sections of the pair of support columns to the ceiling. Accordingly, the length of the support columns need to be aligned with the distance between the floor and ceiling. To achieve this, conventional shelf assemblies must be provided with various pre-prepared support columns with different lengths that correspond to different distances between the floor and the ceiling. As a result, cost is increased.

To address this problem, the inventor of the invention of the application has conceived of the idea of providing comparatively long support columns with an upper end section and a lower end section that can be removed so as to align the length of the support columns with the distance between the floor and the ceiling. However, an upper support portion and a lower support portion to which upper end sections and lower end sections of the wires are respectively connected are fixed to the respective upper end sections and the lower end sections of the support columns. As a result, the upper end section and the lower end section of the support column cannot be removed to adjust the length of the support column to the distance between the floor and the ceiling.

SUMMARY OF THE INVENTION

The invention provides a solution to the above described problem and includes a pair of support columns that stand upright, a shelf board that is supported at both ends thereof in a horizontal direction by the pair of support columns, lower support portions that are respectively provided at respective lower end sections of the pair of support columns, upper support portions that are respectively provided at respective upper end sections of the pair of support columns, a pair of wires provided to extend between the lower support portion and the upper support portion of one of the support columns, and a pair of wires provided to extend between the lower support portion and the upper support portion of the other one of the support columns. In this structure, the lower support portion and the upper support portion are provided on each of the support columns such that the position of at least one of the lower support portion and the upper support portion can be adjusted in an up-down direction.

It is preferable that, in the above structure, each of the support columns includes: a support column body with a length direction that is aligned with the up-down direction, a lower attachment portion which is provided at a lower end section of the support column body such that the lower end section of the support column body can be attached to a floor, and an upper attachment portion which is provided at an upper end section of the support column body such that the upper end section of the support column body can be attached to a ceiling. In this structure, the lower attachment portion and the upper attachment portion are provided on the support column body such that the position of at least one of the lower attachment portion and the upper attachment portion can be adjusted in the up-down direction.

It is preferable that at least one of the upper attachment portion and the lower attachment portion are detachably provided on the support column body.

It is also preferable that a lighting device is provided which lights an upper surface of the shelf board and which is supported by and electrically connected to the pair of wires. In this case, the pair of wires are connected to a power supply.

It is also preferable that the support columns are provided with respective shelf board support portions that have respective positions that can be adjusted in the up-down direction, and that both of the ends of the shelf board are respectively mounted and fixed to the shelf board support portions provided on the support columns, respectively.

It is also preferable that one of the ends of the shelf board is supported by the pair of wires provided on the one of the pair of support columns, and that the other of the ends of the shelf board is supported by the pair of wires provided on the other one of the pair of support columns.

DETAILED DESCRIPTION OF THE PREFERRED EMBODIMENTS

Hereinafter, preferred embodiments of the invention will be described with reference to the drawings.

Figure 1:
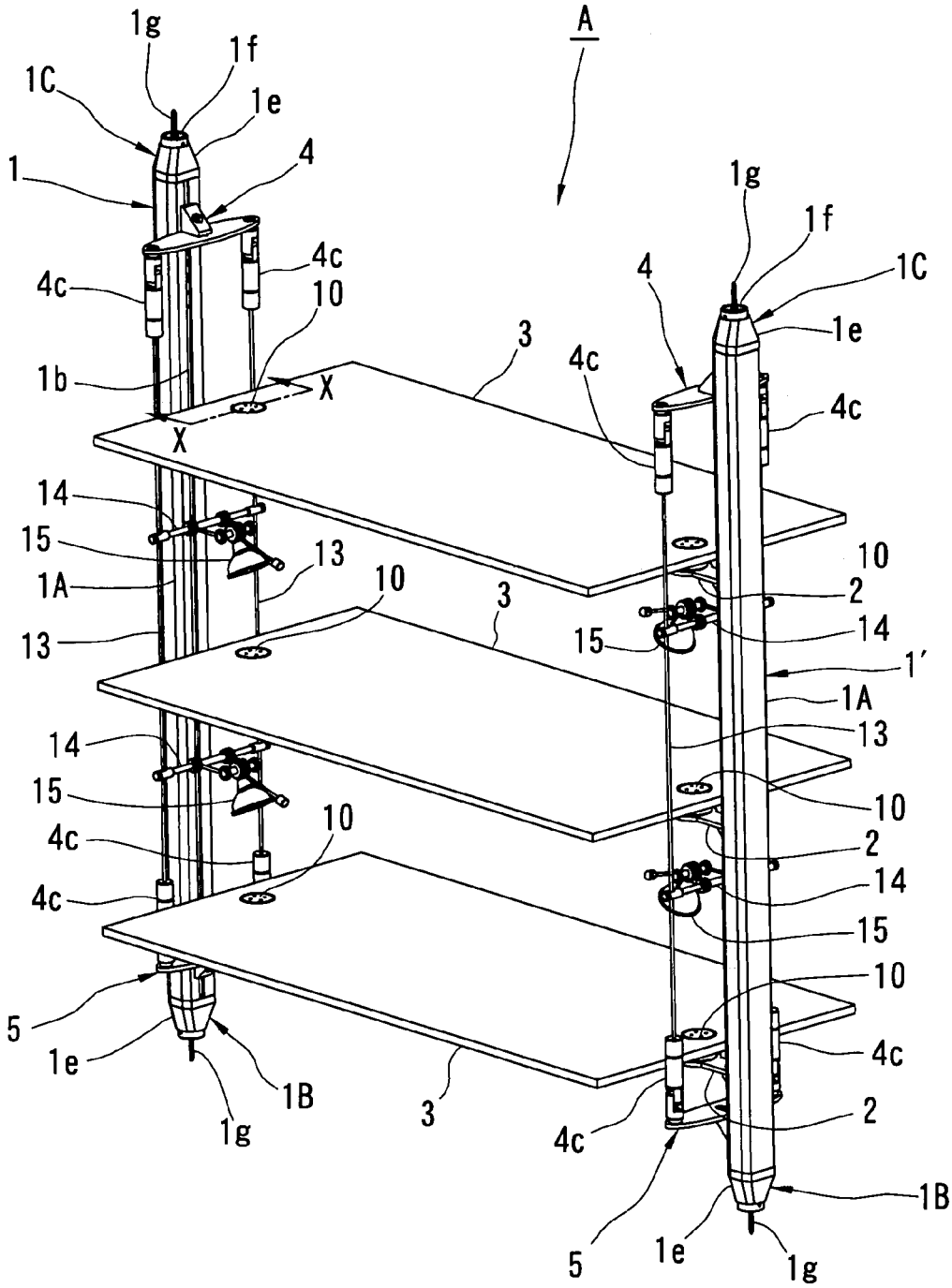
FIG. 1 is a perspective view of a first embodiment of the invention when viewed diagonally from above.
Figure 2:
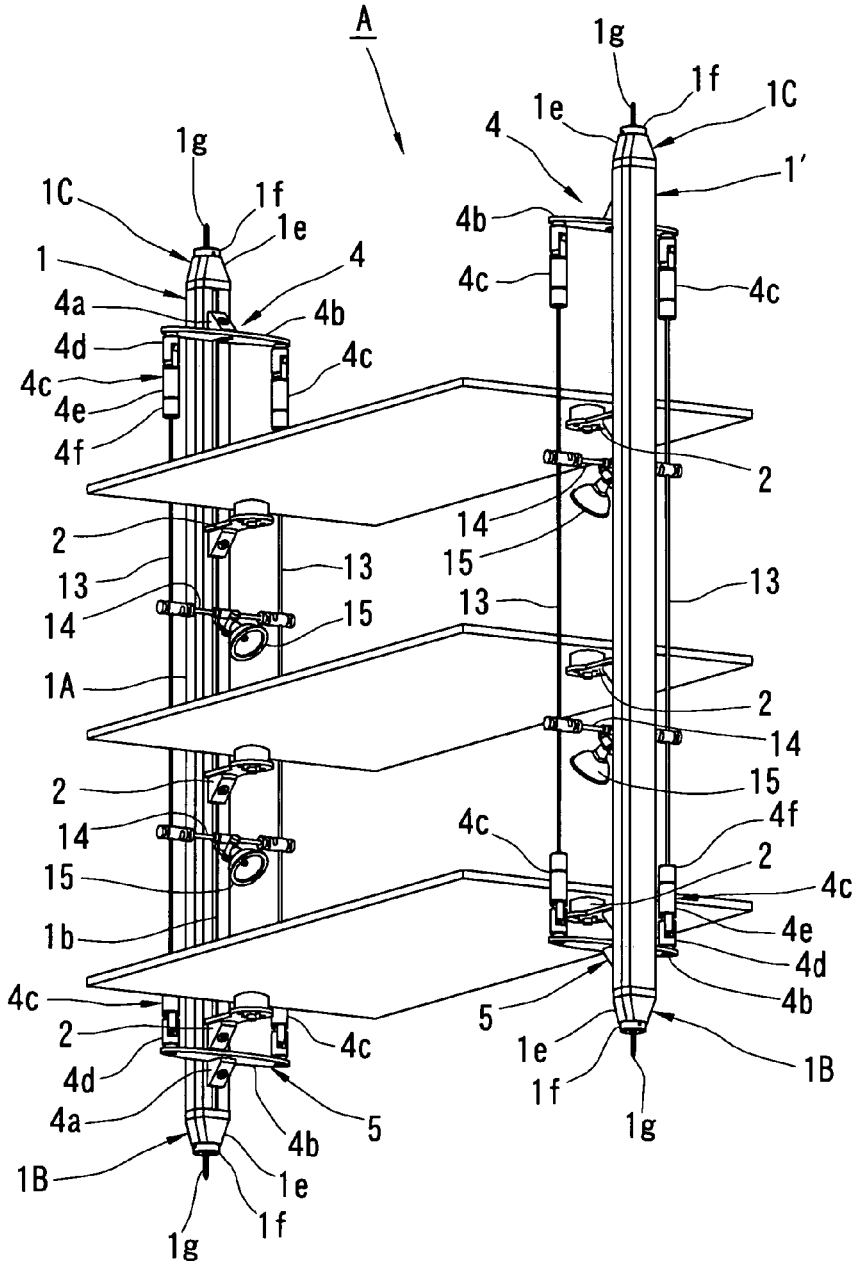
FIG. 2 is a perspective view of the same embodiment when viewed diagonally from below.

FIGS. 1 to 6 show a first embodiment of the invention. As shown by FIGS. 1 and 2, a shelf assembly A of this embodiment includes a pair of support columns 1, 1' that stand upright with the length direction thereof aligned with an up-down direction, a plurality of shelf board support portions 2 that are provided on the respective support columns 1, 1', a plurality of shelf boards 3 that are supported at both ends by the shelf board support portions 2 provided on the pair of support columns 1, 1', upper support portions 4 that are respectively provided at upper end sections of the support columns 1, 1', and lower support portions 5 that are respectively provided at lower end sections of the support columns 1, 1'.

Figure 3:
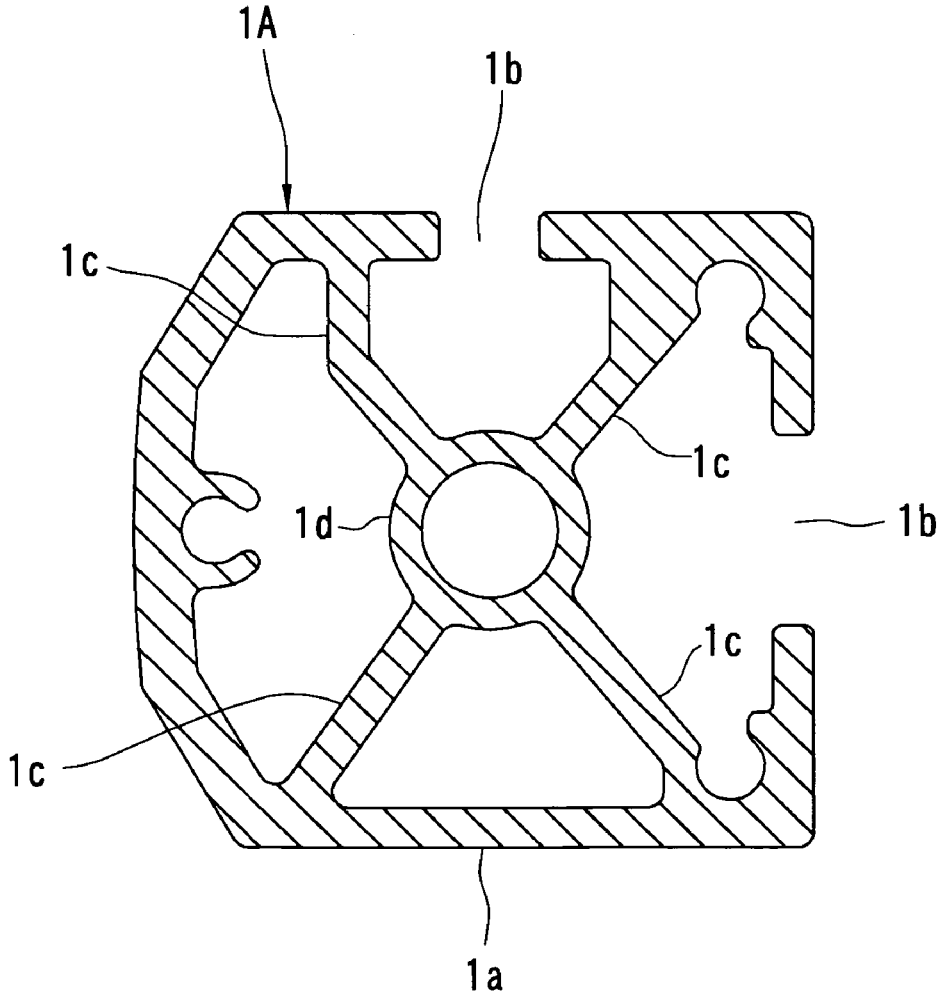
FIG. 3 is a cross section view of a support column body that is used in the same embodiment.

One of the pair of support columns 1, 1', namely, the support column 1 has a support column body 1A, a lower attachment portion 1B provided at the lower end section of the support column body 1A, and an upper attachment portion 1C provided at the upper end section of the support column body 1A. The support column body 1A is made, for example, of a metal like aluminum. As shown in FIG. 3, the support column body 1A has an external wall 1*a* that forms a frame with a generally square cross section. In this external wall 1*a*, attachment grooves 1*b* are formed in a side surface that faces the support column 1', and side surfaces that neighbor on this section. A plurality of reinforcement ribs 1*c* are formed on the internal surface of the external wall 1*a*. A tubular portion 1*d* with a round cross section that extends in the up-down direction is formed in a central portion of the support column body 1A at which inside ends of the reinforcement ribs 1*c* meet.

Figure 6:
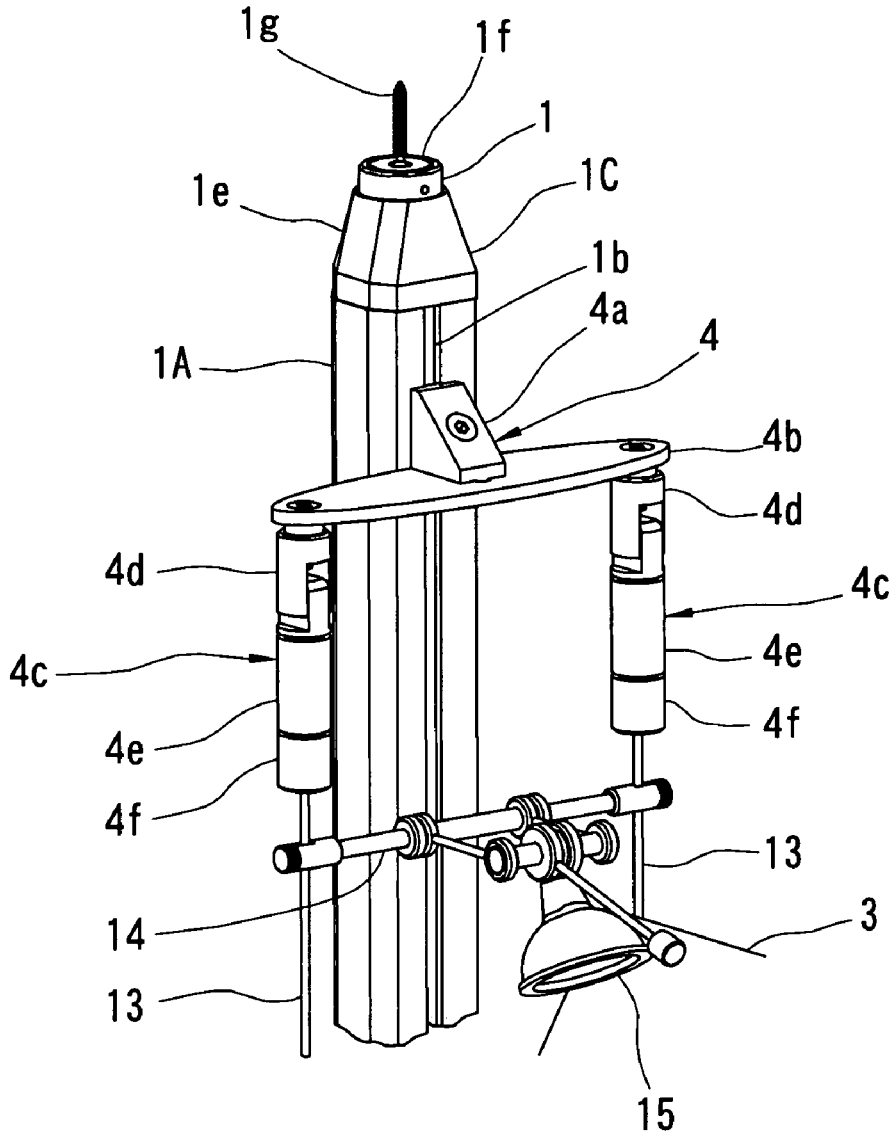
FIG. 6 is an expanded perspective view of a section of the same embodiment.

As shown in FIG. 6, the upper attachment portion 1C includes a fixed member 1*e*, a moveable member 1*f*, and a wood screw 1*g*. The fixed member 1*e* is detachably fixed to the upper end section of the support column body 1A by a screw (not shown) that screws into an upper end opening of the tubular portion 1*d*. The moveable member 1*f* is rotatably provided on the fixed member 1*e* such that the position of the moveable member 1*f* in the up-down direction can be adjusted by a screw mechanism (not shown). The wood screw 1*g* is fixed to the moveable member 1*f*. The moveable member 1*f* is pressed and fixed to the ceiling by rotating the moveable member 1*f* to screw the wood screw 1*g* into the ceiling, whereby the upper attachment portion 1C is fixed to the ceiling and the upper end section of the support column 1 is fixed to the ceiling. In addition, it is possible to adjust the position of the support column body 1A in up-down direction by adjusting the distance between the moveable member 1*f* and the fixed member 1*e* using the screw mechanism.

The lower attachment portion 1B is the same as the upper attachment portion 1C with the exception that it is inverted in the up-down direction. Accordingly, the lower attachment portion 1B also has the fixed member 1*e*, the moveable member 1*f*, and the wood screw 1*g*. The wood screw 1*g* is screwed into the floor such that the moveable member 1*f* is pressed and fixed to the floor. As a result, the lower end section of the support column 1 is fixed to the floor. Of course, the distance between the moveable member 1*f* and the fixed member 1*e* can be adjusted by the screw mechanism, whereby position of the support column body 1A in the up-down direction can be adjusted.

The other of the pair of support columns 1, 1', namely, the other support column 1' is configured to have mirror symmetry with the support column 1. Accordingly, the support column 1' also has the support column body 1A, the lower attachment portion 1B, and the upper attachment portion 1C. Note that, the other structural elements related to the support column 1' are the same as or have mirror symmetry with those of the support column 1. So, the explanation given next will focus on just the support column 1, and a description of the structural elements related to the support column 1' will be omitted.

Figure 4:
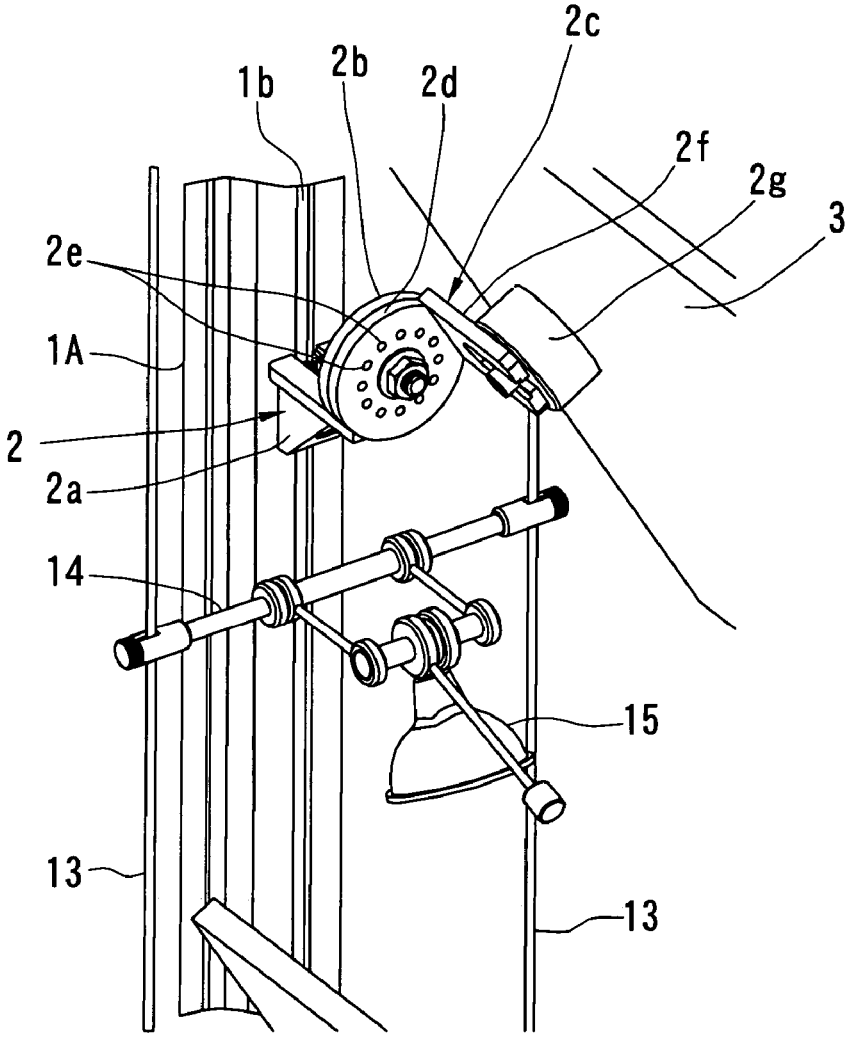
FIG. 4 is an expanded perspective view of one section of the same embodiment.
Figure 5:
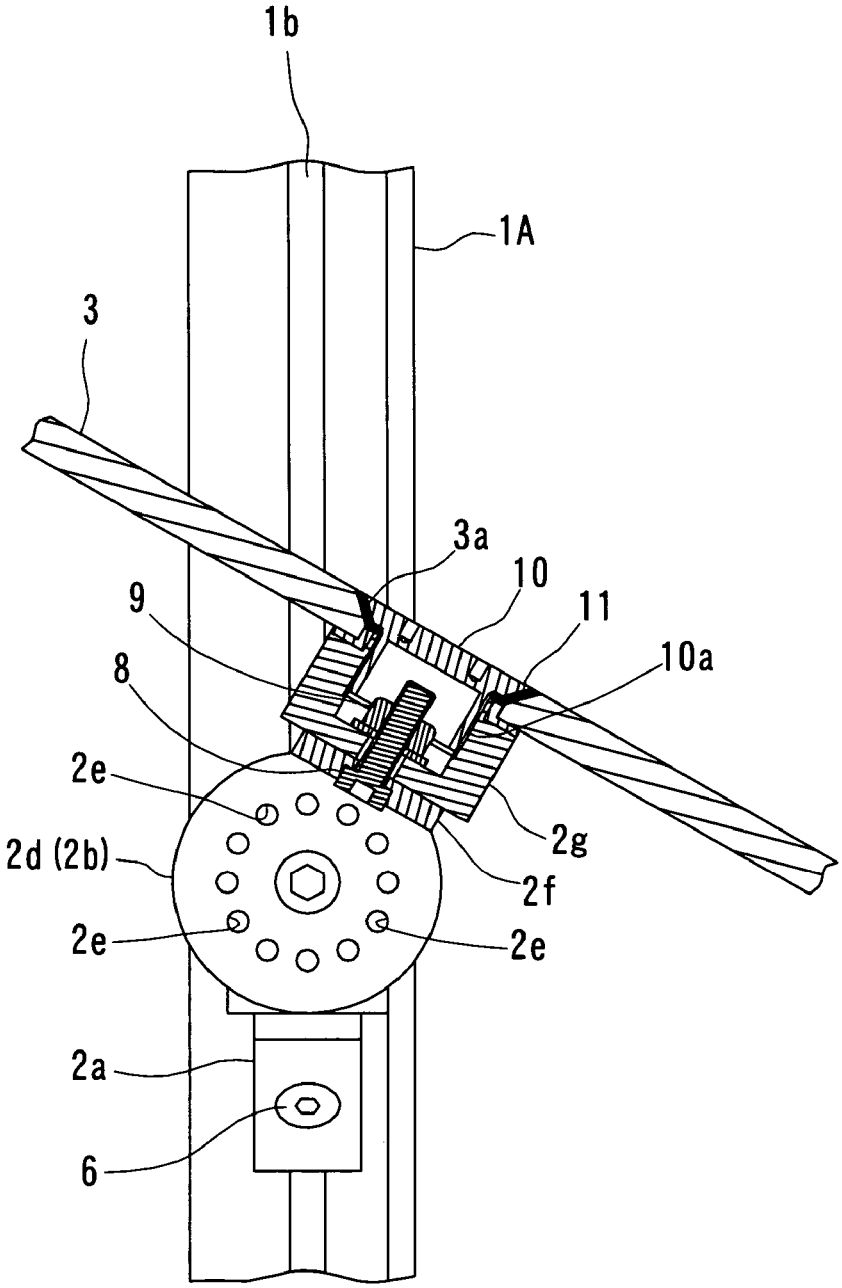
FIG. 5 is an expanded cross section view along a line X-X of FIG. 1.

As is apparent from FIGS. 4 and 5, each shelf board support portion 2 has a moveable support member 2*a*. A portion of this moveable support member 2*a* is inserted in the attachment groove 1*b* so as to be moveable in the up-down direction. The moveable support member 2*a* is fixed to the support column 1 by a screw 6. As a result, the position of the moveable support member 2*a* in the up-down direction can be adjusted by loosening the screw 6. Following this, the screw 6 can be tightened to fix the moveable support member 2*a* to the support column 1. The moveable support member 2*a* has a circular plate 2*b* with an axis that extends in the opposite direction to the support columns 1, 1'(hereinafter referred to as the "left-right direction"). A circular plate 2*d* of a rotation support portion 2*c* is fixed to the circular plate 2*b* by a screw 7 such that the rotation position of the circular plate 2*d* can be adjusted. The rotation position of the circular plate 2*d* with respect to the circular plate 2*b* can be adjusted by fitting a protrusion (not shown) provided on the circular plate 2*b* into any one of a plurality of holes 2*e* provided on the circular plate 2*d*.

The rotation support portion 2*c* has a support plate 2*f* provided at a side portion of the circular plate 2*d*. The support plate 2*f* extends toward the other support column 1' side so as to be orthogonal to the circular plate 2*d*. By adjusting the rotation position of the circular plate 2*d*, the support plate 2*f* can be moved to face in the up-down direction at times when the shelf assembly A is being used normally, or moved, at times when the shelf assembly A is not being used, to face in a direction that is 70 to 80 degrees away from the direction at times when the shelf assembly A is being used normally. In whatever case, the direction of the support plate 2*f* can be suitably changed in accordance with the objective that the shelf assembly A is being used for. A bottom portion of a fixed member 2*g* that has a bottomed tubular shape is fixed to the support plate 2*d* by a bolt 8 and a nut 9.

The shelf board 3 is, for example, a glass board or a decorative board. Attachment holes 3*a* are formed in both ends of the shelf board 3 in the left and right direction. Each attachment hole 3*a* is formed with a tapered shape such that the circumference of each attachment hole 3*a* becomes smaller in the downward direction. An attachment member 10 is fitted in each attachment hole 3*a* via a washer 11. The attachment member 10 has a tubular portion 10*a* that protrudes from the lower surface of the shelf board 3 in the downward direction. The fixed member 2*g* is screwed into this circular portion 10*a*. Accordingly, when the attachment member 10 is rotated such that the tubular portion 10*a* is screwed into the fixed member 2*g*, the attachment member 10 and the fixed member 2*g* sandwich the shelf board 3 in the up-down direction. As a result, one end portion of the shelf board 3 in the left-right direction is fixed to the shelf board support portion 2, and is supported by the support column 1 such that the position of the end portion is adjustable in the up-down direction. Of course, the other end portion of the shelf board 3 is supported via the shelf board support portion 2 by the support column 1' such that the position of the other end portion is adjustable in the up-down direction.

As can be seen from FIG. 6, the upper support portion 4 is provided at the upper end section of the support column 1 such that the position of the upper support portion 4 can be adjusted in the up-down direction. More specifically, the upper support portion 4 has a moveable portion 4*a*. One portion of the moveable portion 4*a* is inserted in the attachment groove 1*b* so as to be moveable in the up-down direction. The moveable portion 4*a* is fixed to the support column 1 using a screw 12. Thus, the position of the moveable portion 4*a* in the up-down direction can be adjusted by loosening the screw 12. After the position of the moveable portion 4*a* has been adjusted, the screw 12 can be tightened firmly to fixed the moveable portion 4*a* in a desired position. Moreover, the direction in which the moveable portion 4*a* faces in the up-down direction can be inverted, and the moveable portion 4*a* attached to the support column 1 in this manner. In this case as well, the moveable portion 4*a* can be attached to the support column 1 such that the position of the moveable portion 4*a* in the up-down direction is adjustable.

A center portion of a support plate 4*b* that extends in the front-rear direction is fixed to the moveable portion 4*a*. Respective connection units 4*c* are fixed to the lower surface at both ends of the support plate 4*b* in the front-rear direction. Each connection unit 4*c* includes a fixed member 4*d* that is fixed to the lower surface of the support plate 4*b*, an intermediate member 4*e* that is coupled to a lower end of the fixed member 4*d* so as to be rotatably around an axis line that extends in the front-rear direction, and a connecting member 4*f* that is screwed to a lower end of the intermediate member 4*e*.

The lower support portion 5 is provided at the lower end section of the support column 1 such that the position of the lower support portion 5 can be adjusted in the up-down direction. The lower support portion 5 is the same as the upper support portion 4 with the exception that it is inverted in the up-down direction. In addition, since the moveable portion 4*a* can be inverted in the up-down direction and attached to the support column 1, the upper support portion 4 may be inverted in the up-down direction and attached and used for the lower support portion 5. Given this, in this explanation, structural elements of the lower support portion 5 that are the same as those of the upper support portion 4 are denoted with the same reference numerals and a description thereof is omitted.

An upper end of a wire 13 is connected to the connecting member 4*f* of the upper support portion 4 so as to be capable of relative rotation with respect to the connecting member 4*f*. A lower end of the wire 13 is connected to the connecting member 4*f* of the lower support portion 5 so as to be capable of relative rotation with respect to the connecting member 4*f*. Accordingly, at least one of the connecting members 4*f* of the upper and lower support portions 4, 5 can be rotated with respect to the intermediate members 4*e* so as to pull the wire 13 upward or downward with a desired degree of strength. A power supply (not shown) is connected to the pair of wires 13, 13 attached to the support column 1. This power source has, for example, a low voltage of about 10V. Thus, even if a person touches the wires 13, 13 no effect on their body is felt.

One end and the other end of a support unit 14 in the front-rear direction are supported on the pair of wires 13, 13 attached to the support column 1 such that the position of the ends can be adjusted in the up-down direction. A lighting device 15 for lighting an upper surface of the shelf board 3 is provided on the support unit 14. The lighting device 15 is electrically connected to the wires 13, 13 via the support unit 14. Accordingly, when the power source is turned ON or OFF, the lighting device 15 is lighted or turned off. In addition, the lighting device 15 is supported rotatably by the support unit 14 in a manner that restricts rotational force appropriately. The lighting device 15 can have its position fixed at a chosen rotation position.

When the shelf assembly A with the above configuration is positioned between the floor and the ceiling, the lower attachment portion 5 is fixed to the floor and the upper support portion 4 is fixed to the ceiling. At this time, the length of the support column 1 is longer than the normal distance between the floor and the ceiling. Thus, the length of the support column 1 is adjusted in accordance with the distance. Adjustment of the length of the support column 1 can be performed by detaching at least one of the lower attachment portion 1B and the upper attachment portion 1C from the support column body 1A, and removing an upper end section and/or a lower end section of the support column body 1A. Following this, the upper and lower attachment portions 1C, 1B can be re-attached to the support column body 1A. Accordingly, this shelf assembly A can be adjusted to correspond with different buildings having different distances between the floor and ceiling. When the lower end section and/or the upper end section of the support column body 1A are removed, if the lower support portion 5 and/or the upper support portion 4 are pre-positioned to the upper side or lower side of the sections to be removed, removal of the sections of the support column body 1A can be performed without difficulty.

Figure 7:
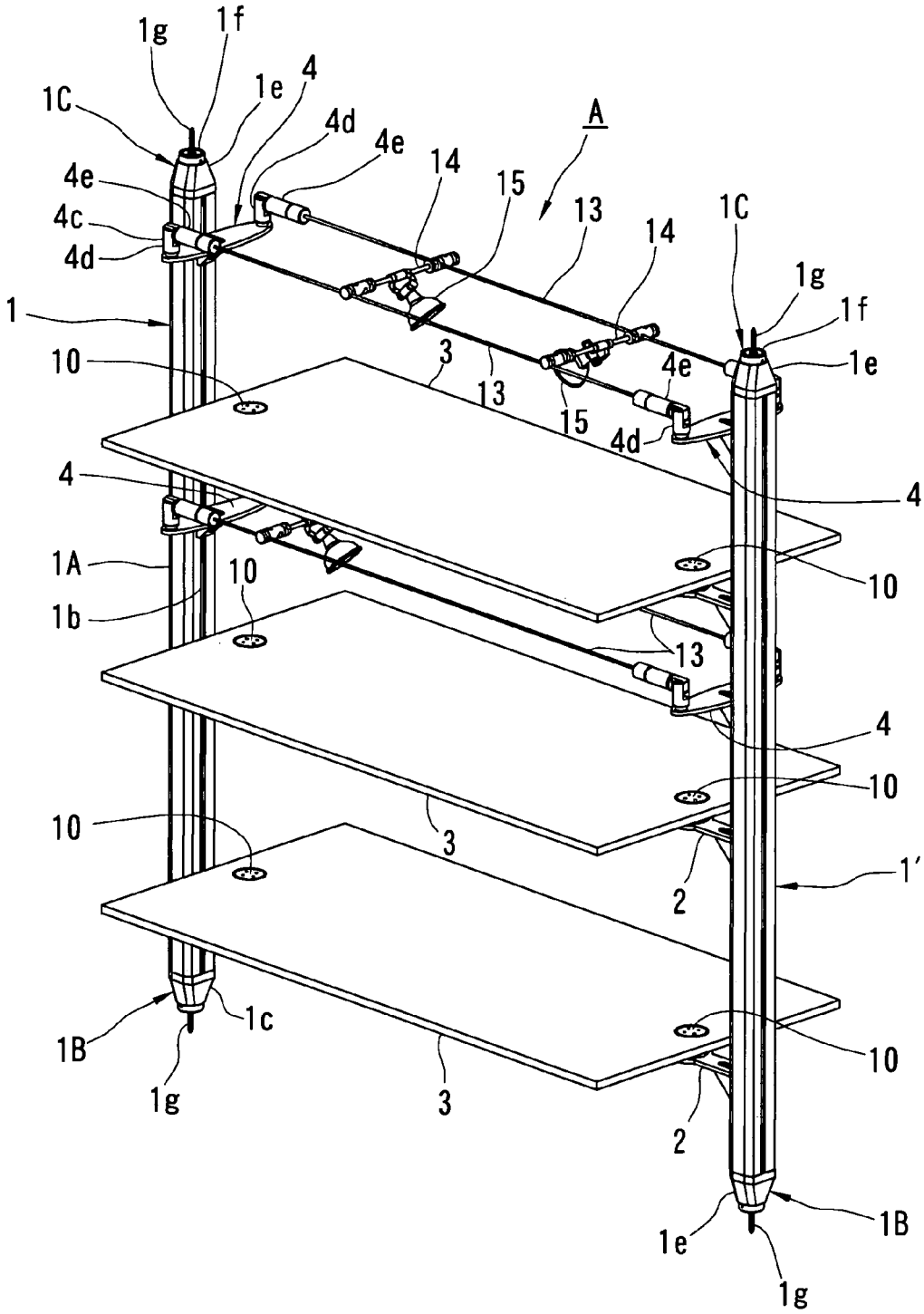
FIG. 7 is a perspective view showing an example of usage of the same embodiment.

Moreover, in the shelf assembly A of this embodiment, the fixed member 4*d* and the intermediate member 4*e* of the connecting unit 4*c* are connected in a rotatable manner. Accordingly, as shown in FIG. 7, the intermediate member 4*e* of the upper support portion 4 (the lower support portion 5) attached to the support column 1 can be faced toward the support column 1' side, and the intermediate member 4*e* of the upper support portion 4 (the lower support portion 5) attached to the support column 1' can be faced toward the support column 1 side. Thus, the shelf assembly A can be used with the one end and the other end in the left-right direction of the wires 13, 13 connected to the connecting members 4*f*, 4*f* of the support columns 1, 1'. The lighting device 15 is supported via the support unit 14 by the pair of wires 13, 13.

Figure 8:
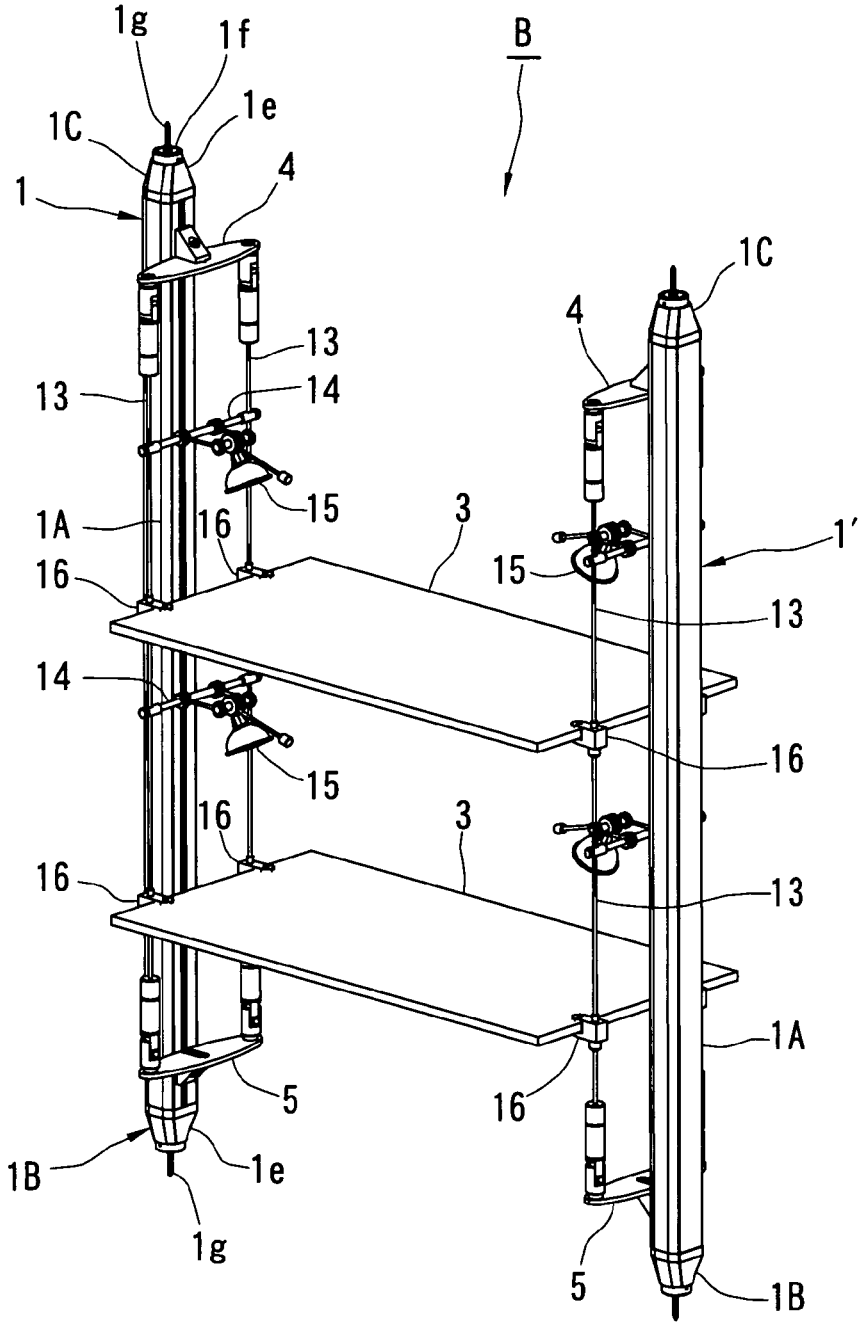
FIG. 8 is a perspective view showing a second embodiment of the invention.
Figure 9:
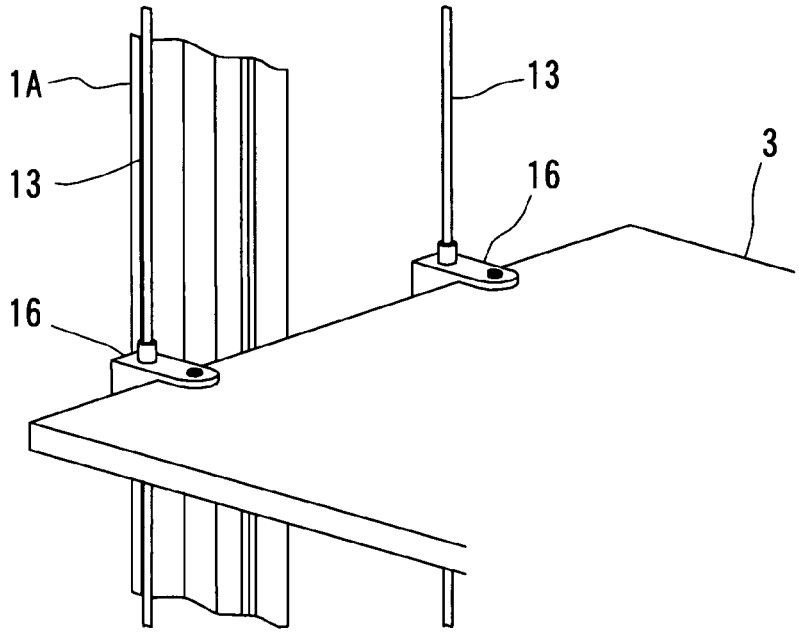
FIG. 9 is an expanded perspective view of a section of the same embodiment when viewed from above.
Figure 10:
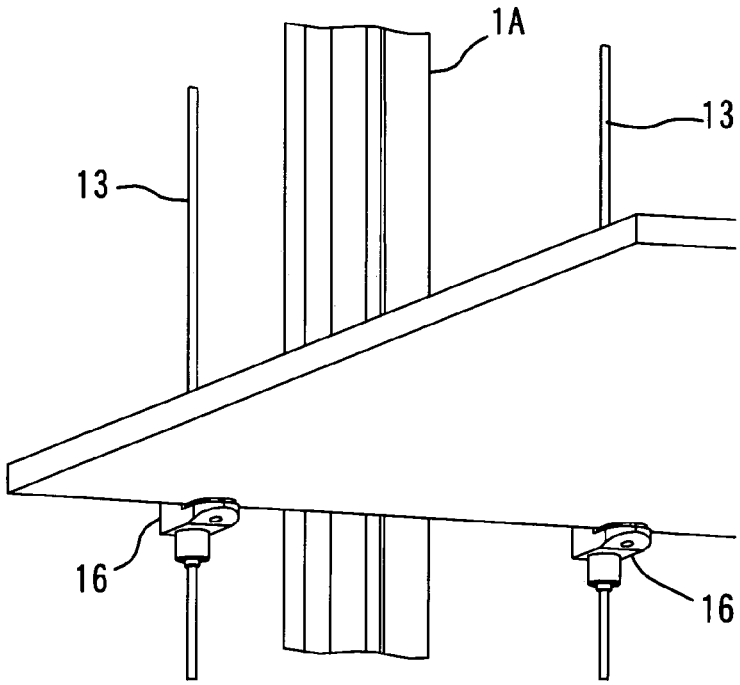
FIG. 10 is an expanded perspective view of the section of the same embodiment when viewed from below.

FIGS. 8 to 10 show a second embodiment of the invention. In a shelf assembly B of this embodiment, the shelf boards 3 are supported by the wires 13. More specifically, support units 16 are fixed to each wire 13 attached to the support column 1. One end of each shelf board 3 is supported by the support unit 16. Similarly, the other end of each shelf board 3 is supported via the support unit 16 by the wire 13 attached to the support column 1'. The other structural elements of this embodiment are the same as those of the previously described embodiment, and thus the same reference numerals are used to denote the structural elements and a description thereof is omitted.

What is claimed is:

1. A shelf assembly comprising:

a pair of support columns that stand upright, a shelf board that is supported at both ends thereof in a horizontal direction by the pair of support columns, lower support portions that are respectively provided at respective lower end sections of the pair of support columns, upper support portions that are respectively provided at respective upper end sections of the pair of support columns, a first pair of wires provided to extend between the lower support portion and the upper support portion of one of the support columns, and a second pair of wires provided to extend between the lower support portion and the upper support portion of the other one of the support columns, wherein the lower support portion and the upper support portion are provided on each of the support columns such that the position of at least one of the lower support portion and the upper support portion can be adjusted in an up-down direction.

2. The shelf assembly according to claim 1, wherein each of the support columns includes:

a support column body with a length direction that is aligned with the up-down direction, a lower attachment portion which is provided at a lower end section of the support column body such that the lower end section of the support column body can be attached to a floor, and an upper attachment portion which is provided at an upper end section of the support column body such that the upper end section of the support column body can be attached to a ceiling, wherein the lower attachment portion and the upper attachment portion are provided on the support column body such that the position of at least one of the lower attachment portion and the upper attachment portion can be adjusted in the up-down direction.

3. The shelf assembly according to claim 2, wherein at least one of the upper attachment portion and the lower attachment portion are detachably provided on the support column body.

4. The shelf assembly according to claim 1, further comprising:

a lighting device which lights an upper surface of the shelf board and which is supported by and electrically connected to the first or second pair of wires wherein the pair of wires is connected to a power supply.

5. The shelf assembly according to claim 2, further comprising:

a lighting device which lights an upper surface of the shelf board and which is supported by and electrically connected to the first or second pair of wires, wherein the pair of wires is connected to a power supply.

6. The shelf assembly according to claim 3, further comprising:

a lighting device which lights an upper surface of the shelf board and which is supported by and electrically connected to the first or second pair of wires, wherein the pair of wires is connected to a power supply.

7. The shelf assembly according to claim 1, wherein the support columns are provided with respective shelf board support portions that have respective positions that can be adjusted in the up-down direction, and both of the ends of the shelf board are respectively mounted and fixed to the shelf board support portions provided on the support columns, respectively.

8. The shelf assembly according to claim 2, wherein the support columns are provided with respective shelf board support portions that have respective positions that can be adjusted in the up-down direction, and both of the ends of the shelf board are respectively mounted and fixed to the shelf board support portions provided on the support columns, respectively.

9. The shelf assembly according to claim 3, wherein the support columns are provided with respective shelf board support portions that have respective positions that can be adjusted in the up-down direction, and both of the ends of the shelf board are respectively mounted and fixed to the shelf board support portions provided on the support columns, respectively.

10. The shelf assembly according to claim 4, wherein the support columns are provided with respective shelf board support portions that have respective positions that can be adjusted in the up-down direction, and both of the ends of the shelf board are respectively mounted and fixed to the shelf board support portions provided on the support columns, respectively.

11. The shelf assembly according to claim 5, wherein the support columns are provided with respective shelf board support portions that have respective positions that can be adjusted in the up-down direction, and both of the ends of the shelf board are respectively mounted and fixed to the shelf board support portions provided on the support columns, respectively.

12. The shelf assembly according to claim 6, wherein the support columns are provided with respective shelf board support portions that have respective positions that can be adjusted in the up-down direction, and both of the ends of the shelf board are respectively mounted and fixed to the shelf board support portions provided on the support columns, respectively.

13. The shelf assembly according to claim 1, wherein one of the ends of the shelf board is supported by the first or second pair of wires provided on the one of the pair of support columns, and the other of the ends of the shelf board is supported by the other of the first and second pair of wires provided on the other one of the pair of support columns.

14. The shelf assembly according to claim 2, wherein one of the ends of the shelf board is supported by the first or second pair of wires provided on the one of the pair of support columns, and the other of the ends of the shelf board is supported by the other of the first and second pair of wires provided on the other one of the pair of support columns.

15. The shelf assembly according to claim 3, wherein one of the ends of the shelf board is supported by the first or second pair of wires provided on the one of the pair of support columns, and the other of the ends of the shelf board is supported by the other of the first and second pair of wires provided on the other one of the pair of support columns.

16. The shelf assembly according to claim 4, wherein one of the ends of the shelf board is supported by the first or second pair of wires provided on the one of the pair of support columns, and the other of the ends of the shelf board is supported by the other of the first and second pair of wires provided on the other one of the pair of support columns.

17. The shelf assembly according to claim 5, wherein one of the ends of the shelf board is supported by the first or second pair of wires provided on the one of the pair of support columns, and the other of the ends of the shelf board is supported by the other of the first and second pair of wires provided on the other one of the pair of support columns.

18. The shelf assembly according to claim 6, wherein one of the ends of the shelf board is supported by the first or second pair of wires provided on the one of the pair of support columns, and the other of the ends of the shelf board is supported by the other of the first and second pair of wires provided on the other one of the pair of support columns.

* * * * *